US007083421B1

(12) United States Patent
Mori

(10) Patent No.: US 7,083,421 B1
(45) Date of Patent: Aug. 1, 2006

(54) ELECTRICAL CONNECTIVITY SYSTEM CAPABLE OF BEING MOUNTED TO AN OBJECT, AND METHOD OF MANUFACTURING SAME

(75) Inventor: Kenneth Mori, Los Angeles, CA (US)

(73) Assignee: Belkin Corporation, Compton, CA (US)

( * ) Notice: Subject to any disclaimer, the term of this patent is extended or adjusted under 35 U.S.C. 154(b) by 0 days.

(21) Appl. No.: 11/137,927

(22) Filed: May 25, 2005

(51) Int. Cl.
*H01R 13/60* (2006.01)

(52) U.S. Cl. ..... 434/574

(58) Field of Classification Search ..... 439/535, 439/574, 575, 652, 653, 654, 540.1; 269/236
See application file for complete search history.

(56) References Cited

U.S. PATENT DOCUMENTS 2,271,463 A * 1/1942 Reeves ..... 439/535
2,647,713 A * 8/1953 Wersching ..... 248/51
2,716,531 A * 8/1955 Johnson ..... 248/51
3,006,589 A * 10/1961 Drysdale ..... 248/74.1
3,049,688 A * 8/1962 Sinopoli ..... 439/41
3,249,351 A * 5/1966 Smith ..... 269/236
3,250,030 A * 5/1966 Lapastora ..... 38/142
3,297,886 A * 1/1967 Danner ..... 307/112
3,473,767 A * 10/1969 Schwaneke ..... 248/51
4,206,910 A * 6/1980 Biesemeyer ..... 269/236
4,747,788 A * 5/1988 Byrne ..... 439/131
4,792,881 A * 12/1988 Wilson et al. ..... 361/827
4,795,141 A * 1/1989 Mulvaney ..... 269/41
4,854,016 A * 8/1989 Rice ..... 24/495
4,875,878 A * 10/1989 Meyer ..... 439/501
5,057,039 A * 10/1991 Persing et al. ..... 439/574
5,176,343 A * 1/1993 Cheney et al. ..... 248/51
5,364,084 A * 11/1994 Karash ..... 269/41
5,402,972 A * 4/1995 Schmidt ..... 248/118
5,472,157 A * 12/1995 Lehrman ..... 248/51
5,702,075 A * 12/1997 Lehrman ..... 248/51
5,899,761 A * 5/1999 Crane et al. ..... 439/142
5,964,618 A * 10/1999 McCarthy ..... 439/574
6,004,157 A * 12/1999 Glass ..... 439/574
6,098,859 A * 8/2000 Bortner ..... 224/272
6,174,199 B1 * 1/2001 Rushing ..... 439/575
6,179,665 B1 * 1/2001 Rossman et al. ..... 439/654

(Continued)

OTHER PUBLICATIONS

Picture of a device made by Power Sentry, namely, a surge protector/power strip coupled to a clamp. The photograph of which this picture is a copy was taken on or around May 17, 2005.

*Primary Examiner*—Ross Gushi
(74) *Attorney, Agent, or Firm*—Bryan Cave LLP

(57) ABSTRACT

An electrical connectivity system capable of being mounted to an object includes a housing (110), a mounting mechanism (120) integrated with the housing, and a power cord (130). The housing includes an electrical connection port (111) and a cavity (112) capable of engaging the object. The mounting mechanism is integrated with the housing and is capable of retaining the cavity in engagement with the object. The power cord is also integrated with the housing and is capable of delivering electric power to the electrical connection port. In an alternate embodiment, an electrical connectivity system includes a housing (310) having an electrical connection port (311) and a mounting bracket (320) having a mounting mechanism (350) and a cavity (340). The mounting bracket may be coupled to the housing using apertures in the mounting bracket and the housing.

16 Claims, 5 Drawing Sheets

U.S. PATENT DOCUMENTS 6,183,280 B1 * 2/2001 Laukhuf ..... 439/214
6,229,691 B1 * 5/2001 Tanzer et al. ..... 361/622
6,234,812 B1 * 5/2001 Ivers et al. ..... 439/131
6,243,257 B1 * 6/2001 Ester ..... 361/625
6,300,570 B1 * 10/2001 Lai ..... 174/67
6,315,604 B1 * 11/2001 Lee ..... 439/535
6,379,182 B1 * 4/2002 Byrne ..... 439/574
6,435,461 B1 * 8/2002 Saylor et al. ..... 248/231.71
6,540,554 B1 * 4/2003 McCarthy ..... 439/574
6,589,073 B1 * 7/2003 Lee ..... 439/535
6,642,450 B1 * 11/2003 Hsiao ..... 174/53
6,713,674 B1 * 3/2004 Chang ..... 174/50
6,717,053 B1 * 4/2004 Rupert ..... 174/53
6,748,707 B1 * 6/2004 Buchalter et al. ..... 52/220.1
6,752,653 B1 * 6/2004 Morlock et al. ..... 439/527
6,811,281 B1 * 11/2004 Hsiao ..... 362/641
6,885,796 B1 * 4/2005 Lubkert et al. ..... 385/48
6,897,379 B1 * 5/2005 Hsiao ..... 174/53
2002/0119698 A1 * 8/2002 McCarthy ..... 439/574

* cited by examiner

ELECTRICAL CONNECTIVITY SYSTEM CAPABLE OF BEING MOUNTED TO AN OBJECT, AND METHOD OF MANUFACTURING SAME

FIELD OF THE INVENTION

This invention relates generally to electrical connectivity systems, and relates more particularly to such systems capable of being mounted to an object.

BACKGROUND OF THE INVENTION

Electric devices require electric power and/or data signals in order to function, and electrical connectivity systems of many descriptions have been developed for the purpose of delivering such power and data signals. Electrical connectivity systems include wall outlets, power strips, and surge protectors that deliver electric power in the form of alternating current (AC), and further include phone jacks, Ethernet ports, USB and FireWire hubs, cable and Internet connection ports, and other products containing outlets, jacks, or ports that deliver electric power and/or data required by an electronic device.

In many cases it is desirable to temporarily position the electrical connectivity system in a particular place convenient to a worksite where an electric device is to be used. Some existing electrical connectivity systems have mounting strips, screw loops, or other features that allow them to be permanently or semi-permanently attached to a mounting surface such as a wall or table. A smaller number of existing electrical connectivity systems have mounting mechanisms that enable temporary attachment, but these tend to be unwieldy, bulky, or otherwise poorly suited for such temporary attachment. Accordingly, there exists a need for an electrical connectivity system that is neat and compact, easy to use, and capable of being securely mounted to an object while also being easily removed from the object when such mounting is no longer desired.

BRIEF DESCRIPTION OF THE DRAWINGS

The invention will be better understood from a reading of the following detailed description, taken in conjunction with the accompanying figures in the drawings in which.

Figure 1:
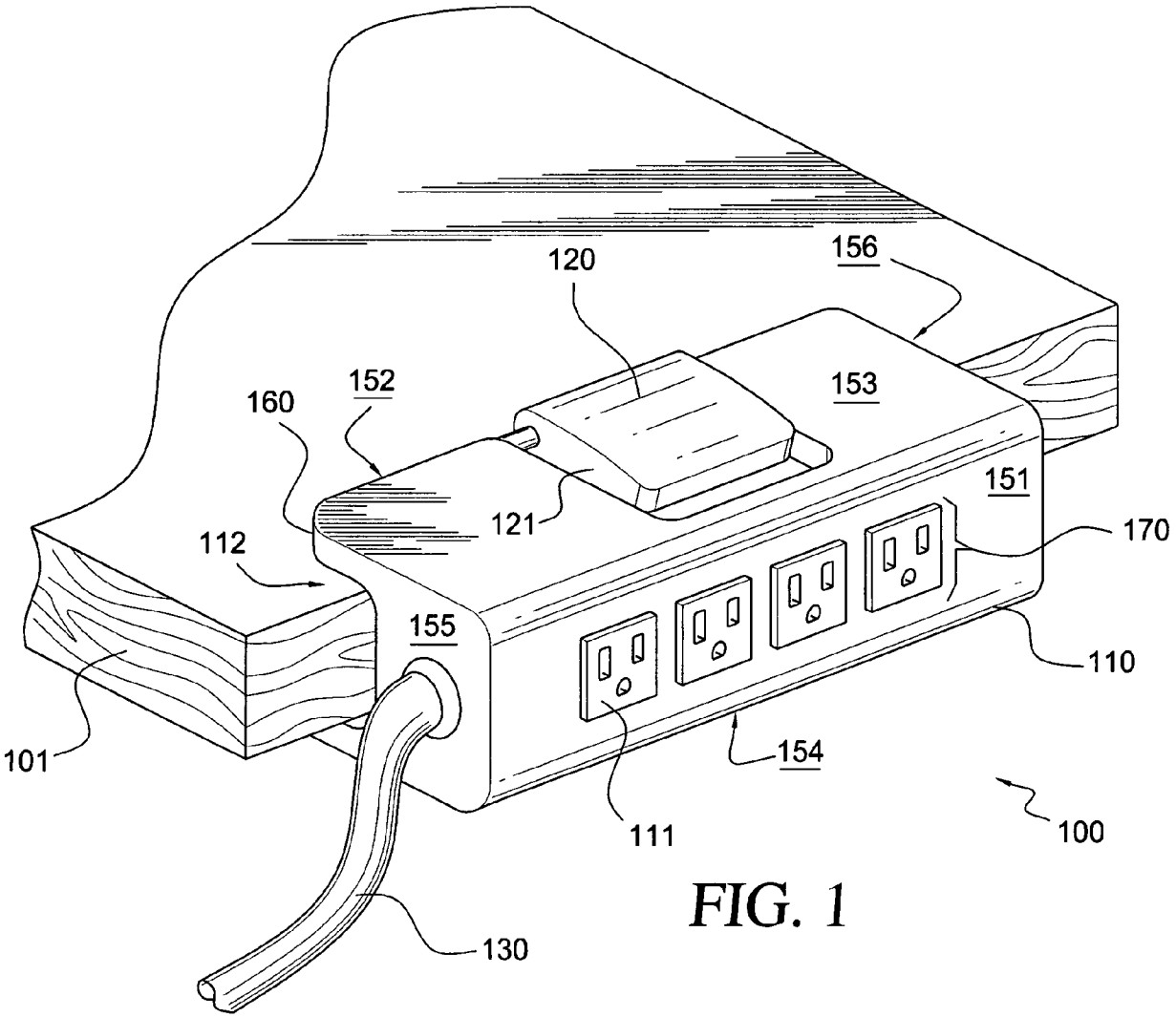
FIG. 1 is a perspective view of an electrical connectivity system mounted to an object according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, an electrical connectivity system capable of being mounted to an object comprises a housing, a mounting mechanism integrated with the housing, and a power cord. The housing comprises an electrical connection port and a cavity capable of engaging the object. The mounting mechanism is integrated with the housing and is capable of retaining the cavity in engagement with the object. The power cord is also integrated with the housing and is capable of delivering electric power to the electrical connection port.

Referring now to the figures, FIG. 1 is a perspective view of an electrical connectivity system 100 mounted to an object 101 according to an embodiment of the invention. As illustrated in FIG. 1, electrical connectivity system 100 comprises a housing 110 having an electrical connection port 111 and a cavity 112. A mounting mechanism 120 and a power cord 130 are integrated with housing 110 and capable of delivering electric power to electrical connection port 111. Suitable materials for housing 110, mounting mechanism 120, and power cord 130, along with any components thereof, are known in the art, and will thus not be further described herein. One of ordinary skill in the art will be able to select such materials according to known standards and selection criteria.

In the illustrated embodiment, object 101 is oriented generally horizontally, as a desktop or tabletop would be. It should be understood that electrical connectivity system 100 may just as easily be a mounted to an object oriented generally vertically, as in the case of a wall stud or the like. Furthermore, electrical connectivity system 100 may be mounted to various surfaces of such objects, such that electrical connection port 111 can be presented in any of a variety of orientations, including, for example, vertically, horizontally, facing toward or away from a surface on which object 101 rests, and facing toward or away from a particular wall of a room.

In the illustrated embodiment, electrical connection port 111 is an electrical power outlet. However, electrical connection port 111 can be any port, outlet, jack, or the like that supplies an electric signal usable by an electric device. As it is used herein, the phrase "electric device" refers to any device using electricity, and includes power tools, appliances, electronic devices such as computers, computer peripherals, telephones, personal digital assistants (PDAs), pocket PCs, and the like, and many other devices. In addition to electrical connection port 111, housing 110 also comprises circuitry necessary for the functioning of electrical connection port 111. Such circuitry, since it is known in the art, is not further described herein.

Housing 110, in various embodiments, may take a variety of shapes such that housing 110 has a variety of cross sections. As an example, housing 110 can have a cross section that is substantially a circle, a triangle, a rectangle, a pentagon, or some other polygon. In the drawings and in the discussion that follows, housing 110 will be shown and described as having a rectangular cross section, but such drawings and discussion should not be thought of as limiting housing 110 to that particular shape.

Cavity 112 is capable of engaging object 101, meaning that a portion of object 101 is able to fit inside cavity 112 in such a way that housing 110 may be securely attached to object 101 in a manner to be described below. It is understood that cavity 112 comprises a void or empty space such that to describe cavity 112 is technically to describe something that isn't there, in the sense that cavity 112 is not a tangible item. However, the discussion herein taken together with the accompanying figures will be sufficient for one of ordinary skill in the art, at least, to clearly understand what is being described.

Although electrical connectivity system 100 may be mounted to objects having a variety of shapes, thicknesses, and descriptions, it is contemplated that electrical connectivity system 100 will often be mounted to an object that is or has the general characteristics of a two-by-four, i.e., have a cross section with one dimension that is roughly two inches and another dimension that is roughly four inches. (As is well known, the dimensions of a finished two-by-four are actually somewhat less than two inches by four inches.) In an unfinished garage or basement, for example, the exposed wall studs are generally two-by-fours or two-by-sixes. Tabletops and desktops are generally no thicker than a two-by-four. Sawhorses, often used at worksites, frequently have a cross piece of the same general dimensions. In summary, an electrical connectivity system capable of being mounted to a two-by-four would be capable of being mounted to a large number, and perhaps a majority, of the objects to which one might desire to mount it. Accordingly, in one embodiment of the invention, cavity 112 has an effective width no greater than two inches. In the claims, and hereafter in this discussion, measurements will be expressed in metric rather than English units. The metric equivalent of two inches, rounded to the nearest whole number, is five centimeters.

The phrase "effective width" as used in the preceding paragraph, and elsewhere herein, means the width of that portion of cavity 112 that can actually be occupied by object 101. In a case where no other object or body is in cavity 112, the effective width is equal to the actual distance between the two extremities of cavity 112, i.e., between a portion of cavity 112 that is adjacent to surface 153 and a portion of cavity 112 that is adjacent to surface 154.

In one embodiment, electrical connectivity system 100 further comprises an adapter or shim capable of being inserted within cavity 112. Such adapter or shim reduces the effective width of cavity 112 by decreasing the portion of cavity 112 that may be occupied by object 101. An example of a suitable adapter is a sleeve or collar having the same general shape as cavity 112 but having smaller dimensions. By inserting such adapter or shim in cavity 112, electrical connectivity system 100 may be made mountable to tabletops, wall studs, sawhorse cross pieces, or other objects with thicknesses or widths that are less than that of a standard two-by-four.

In a different embodiment, mounting mechanism 120 is adjustable such that the effective width of cavity 112 may be adjusted without the use of an adapter or shim, thereby making electrical connectivity system 100 mountable to objects such as those mentioned above having thicknesses or widths that are less than that of a standard two-by-four. As an example, mounting mechanism 120 can use a toggle clamp such as is used in vice grip pliers, a ratchet mechanism, or the like, all of which are known in the art and so will not be further described herein.

Mounting mechanism 120 is integrated with housing 110, and is capable of retaining cavity 112 in engagement with object 101 until mounting mechanism 120 is released and electrical connectivity system 100 is removed from object 101. In the illustrated embodiment, mounting mechanism 120 is a cam-lock having a lever 121 that may be rotated to lock and release mounting mechanism 120, as known in the art. In a non-illustrated embodiment, mounting mechanism 120 could be a clamp, a spring-loaded device, a toothed device capable of digging into object 101, or any other device suitable for maintaining cavity 112 in engagement with object 101. As an example, mounting mechanism 120 can be any mechanism that increases friction between a portion of electrical connectivity system 100 and object 101 such that housing 110 and object 101 may be retained in engagement with each other.

Electrical connectivity system 100 may be used in various settings where it is desirable to position an electrical connection port in an easily accessible location. As an example, the electrical connection port can be a USB or FireWire port, and the location can be near a desktop or other workstation. The portability offered by electrical connectivity system 100 may be desirable in such a setting to, for example, a person who works at multiple workstations having too few USB/FireWire ports, and who wishes to carry the additional ports offered by electrical connectivity system 100 when moving from one workstation to another. As another example, the electrical connection port can be a phone jack or an Ethernet port and the location can be near a fax machine, a digital video recorder, or the like. As yet another example, the electrical connection port can be a power outlet and the location can be a garage or other household area, a worksite, or anyplace where electric power tools and the like may be used. In each of the above examples, as well as is in a large number of other situations not mentioned above, it may be desirable and useful to move the electrical connection port from one location to another and to temporarily attach it in the location currently in use. Existing electrical connectivity systems are not conducive to, or do not even allow, such temporary attachment. However, as described below, it is just this sort of temporary attachment for which electrical connectivity system 100 is designed.

In one embodiment, as mentioned above, housing 110 has a rectangular structure comprising a surface 151, a surface 152 spaced apart from and substantially parallel to surface 151, a surface 153 substantially perpendicular to and extending between surface 151 and surface 152, and a surface 154 spaced apart from surface 153 and substantially perpendicular to and extending between surfaces 151 and 152. Housing 110 further comprises a surface 155 substantially perpendicular to and stretching between surfaces 151 and 152, and substantially perpendicular to and stretching between surfaces 153 and 154. Housing 110 still further comprises a surface 156 spaced apart from and substantially parallel to surface 155, substantially perpendicular to and stretching between surfaces 151 and 152, and substantially perpendicular to and stretching between surfaces 153 and 154.

Power cord 130 exits housing 110 at one of surfaces 155 and 156. If it is important or desired that power cord 130 exit housing 110 is a particular direction, electrical connectivity system 100 may be turned or rotated such that power cord 130 does exit housing 110 in that particular direction. As an example, if electrical connectivity system 100 is oriented substantially horizontally and power cord 130 must exit housing 110 to the left, then electrical connectivity system 100 may be oriented as shown in FIG. 1. If instead power cord 130 should exit housing 110 to the right, electrical connectivity system 100 may be rotated 180 degrees such that surface 153 is under object 101 and surface 154 is over object 101. Similarly, if electrical connectivity system 100 is oriented substantially vertically, electrical connectivity system 100 may be oriented such that power cord 130 either exits at the top or at the bottom.

Electrical connection port 111 is located at surface 151 and cavity 112 is located at surface 152. In the illustrated embodiment, electrical connection port 111 is one of a plurality 170 of electrical connection ports. It is contemplated that plurality 170 will comprise between three and twelve electrical connection ports, although more or fewer electrical connection ports may also make up plurality 170.

A face 160 above cavity 112, and a similar face (not visible in FIG. 1 but) below cavity 112 may either be thought of as portions of surface 152 or as portions of surfaces 153 and 154, respectively. In the first scenario, cavity 112 takes up less than all of surface 152. In the second scenario, face 160 would constitute the thickness of surface 153, and cavity 112 would be thought of as occupying all of surface 152.

In a non-illustrated embodiment, electrical connectivity system 100 further comprises a second electrical connection port (not shown) at surface 153 instead of or in addition to electrical connection port 111 at surface 151. In a different non-illustrated embodiment, electrical connectivity system 100 still further comprises a third electrical connection port (also not shown) at surface 154. The third electrical connection port can be in place of or in addition to the second electrical connection port and/or electrical connection port 111. The second electrical connection port can be one of a plurality of electrical connection ports located at surface 153. Similarly, the third electrical connection port can be one of a plurality of electrical connection ports located at surface 154. Although it is not illustrated, surface 155 and/or surface 156 may also be the location of one or more electrical connection ports.

Depending on the orientation electrical connectivity system 100 when it is mounted to object 101, one or another of the above-described embodiments may be more desirable or suitable than the others. As an example, when electrical connectivity system 100 is oriented as shown in FIG. 1, in a generally horizontal configuration with surface 154 located under or lower than surface 153, having electrical connection ports located at surfaces 151 and/or 153 may be more desirable than having electrical connection port 111 located at the less-accessible surface 154. As another example, when electrical connectivity system 100 is oriented such that it is turned ninety degrees in any direction from the orientation shown in FIG. 1, it may be desirable to have electrical connection ports located at all three of surfaces 151, 153, and 154. Other considerations, such as size or weight restrictions, may also dictate which surface or surfaces at which electrical connection port 111 or another electrical connection port is located.

Figure 2:
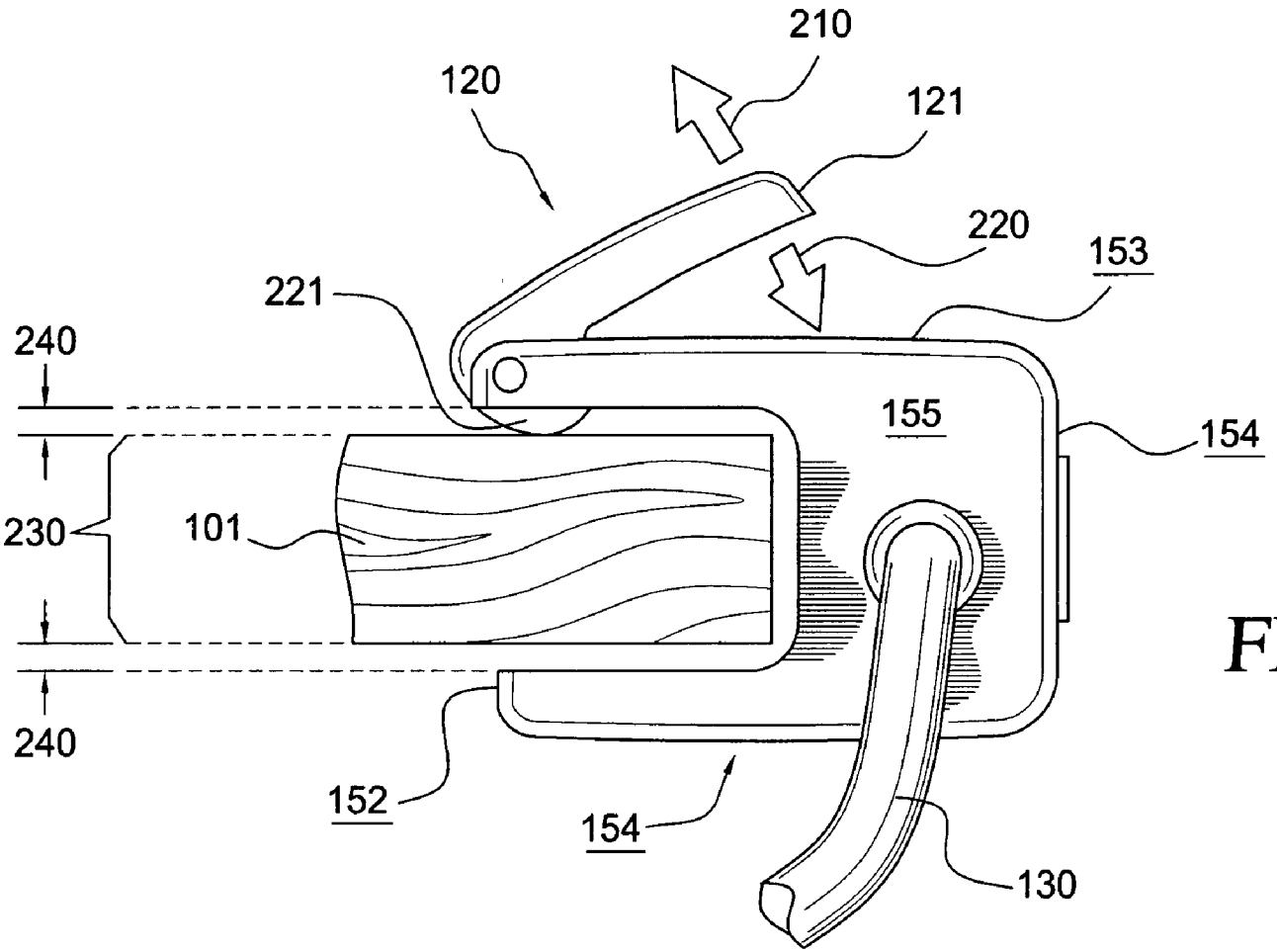
FIG. 2 is a side elevational view of the electrical connectivity system of FIG. 1 according to an embodiment of the invention.

FIG. 2 is a side elevational view of electrical connectivity system 100 according to an embodiment of the invention. FIG. 2 illustrates an embodiment in which mounting mechanism 120 is located at surface 153 of housing 110. An arrow 210 indicates a direction of movement for lever 121 that moves lever 121 toward an open or unlocked position in which lever 121 is substantially perpendicular to surface 153. An arrow 220 indicates a direction of movement for lever 121 that moves lever 121 toward a closed or locked position in which lever 121 is substantially parallel to and substantially flush with surface 153. A portion 221 of mounting mechanism 120 extends away from surface 153 into cavity 112 and toward surface 154. When lever 121 is in, or is moved toward, the closed position, portion 221 of mounting mechanism 120 contacts object 101 when object 101 is inserted in cavity 112.

In order to mount electrical connectivity system 100, a portion of object 101 is placed within cavity 112 and mounting mechanism 120 is closed or locked, such as by placing lever 121 in the closed position. As an example, portion 221 of mounting mechanism 120 presses against object 101 such that friction is created between object 101 and portion 221. Such friction, in one embodiment, makes it difficult or impossible to remove object 101 from cavity 112. Continuing the example, in one embodiment, cavity 112 comprises a portion 230 and a portion 240 exterior to portion 230. Object 101 fills portion 230 and does not fill portion 240 when object 101 is inserted in cavity 112. In other words, portion 230 is that portion of cavity 112 that is filled by object 101 when object 101 is inserted in cavity 112. As illustrated, portion 221 of mounting mechanism 120 extends across portion 240 of cavity 112 and contacts object 101 when object 101 is inserted in cavity 112 and lever 121 is in the closed position. When lever 121 is moved toward the open position, portion 221 of mounting mechanism 120, because it is irregularly shaped, rotates out of contact with object 101 thus freeing object 101 to be removed from cavity 112.

Figure 3:
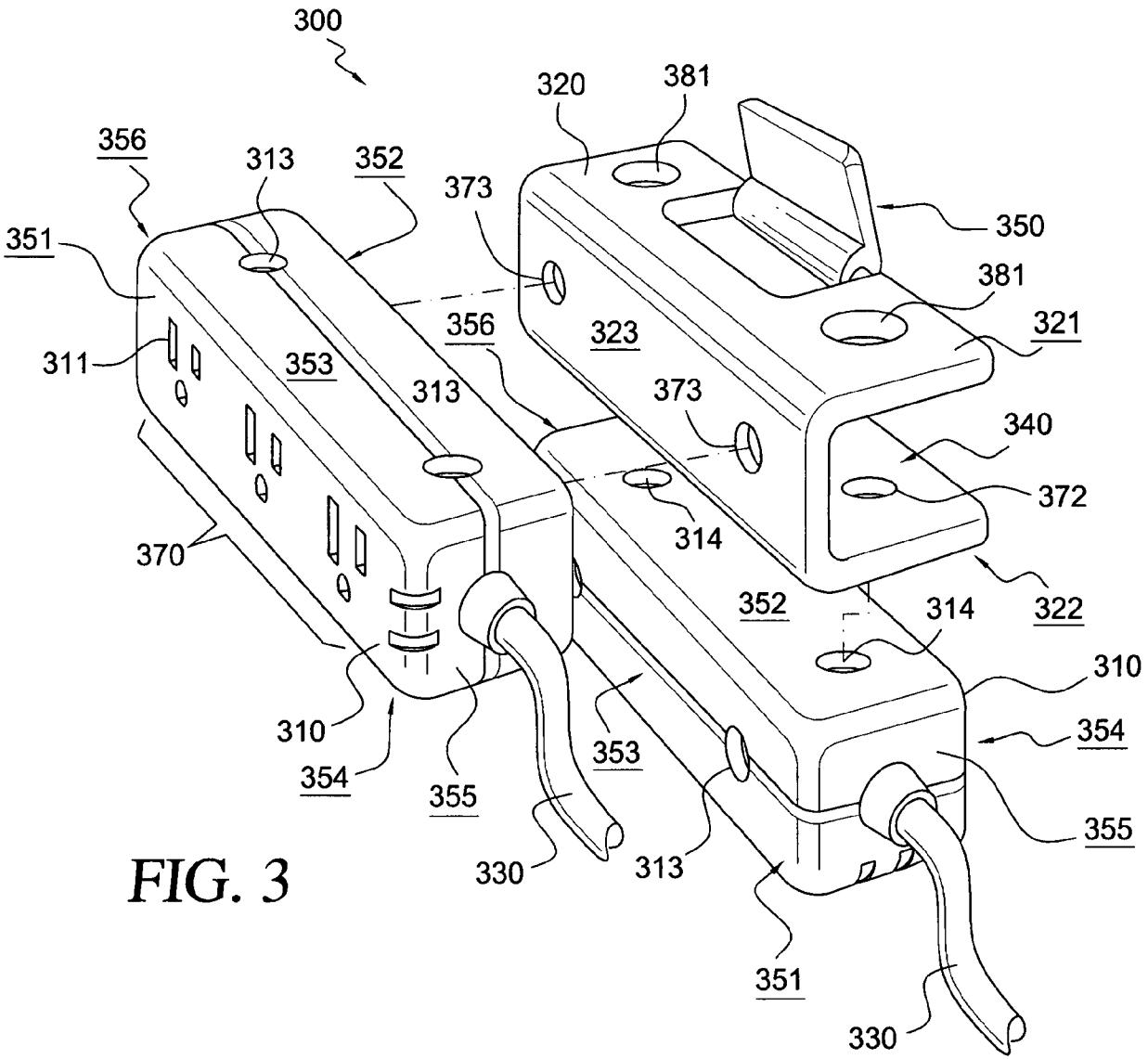
FIG. 3 is a perspective view of a different electrical connectivity system according to an embodiment of the invention.

FIG. 3 is a perspective view of an electrical connectivity system 300 according to an embodiment of the invention. As is true of electrical connectivity system 100, shown in and discussed in connection with FIGS. 1 and 2, electrical connectivity system 300 is also capable of being mounted to an object. Such object is not illustrated in FIG. 3, but it may be similar to object 101, first shown in FIG. 1.

As illustrated in FIG. 3, electrical connectivity system 300 comprises a housing 310, a mounting bracket 320, and a power cord 330. Housing 310 comprises an electrical connection port 311, which may be one of a plurality 370 of electrical connection ports. Although it is not explicitly illustrated in FIG. 3, one or more of plurality 370 or a different (non-illustrated) plurality of electrical connection ports can be located at a surface of housing 310 other than surface 351. Power cord 330 is integral with housing 310 and is capable of delivering electric power to electrical connection port 311. Housing 310 is shown in two positions in FIG. 3 in order to illustrate that it may be connected to mounting bracket 320 at more than one location, as will be further discussed below.

Mounting bracket 320 is capable of being coupled to housing 310 and comprises a cavity 340 capable of engaging the object. Mounting bracket 320 further comprises a mounting mechanism 350 capable of retaining cavity 340 in engagement with the object. As an example, cavity 340 can be similar to cavity 112, and mounting mechanism 350 can be similar to mounting mechanism 120, both of which were first shown in FIG. 1.

In the illustrated embodiment, mounting bracket 320 comprises a surface 321, a surface 322 spaced apart from and substantially parallel to surface 321, and a surface 323 substantially perpendicular to and extending between surface 321 and surface 322. Surfaces 321, 322, and 323 define cavity 340 by bounding cavity 340 on three sides. Mounting mechanism 350 is at surface 321. Surface 322 has an aperture 372 located therein, and surface 323 has an aperture 373 located therein.

Also in the illustrated embodiment, housing 310 has a rectangular structure comprising a surface 351, a surface 352 spaced apart from and substantially parallel to surface 351, a surface 353 substantially perpendicular to and extending between surface 351 and surface 352, and a surface 354 spaced apart from surface 353 and substantially perpendicular to and extending between surfaces 351 and 352. Housing 310 further comprises a surface 355 substantially perpendicular to and stretching between surfaces 351 and 352, and substantially perpendicular to and stretching between surfaces 353 and 354. Housing 310 still further comprises a surface 356 spaced apart from and substantially parallel to surface 355, substantially perpendicular to and stretching between surfaces 351 and 352, and substantially perpendicular to and stretching between surfaces 353 and 354.

As illustrated in FIG. 3, electrical connection port 311 is located at surface 351. Power cord 330 exits housing 310 at one of surface 355. At surface 353, housing 310 comprises a threaded aperture 313. At surface 352, housing 310 comprises a threaded aperture 314. It was mentioned above that housing 310 may be connected to mounting bracket 320 at more than one location, and it is the presence of threaded apertures 313 and 314 on two surfaces of housing 310 that makes such options available. As an example, surface 352 of housing 310 and surface 323 of mounting bracket 320 may be placed adjacent to each other, apertures 373 and threaded apertures 314 may be aligned with each other, and a fastening device such as a screw may be inserted through the apertures. The result is that electrical connection port 311 faces away from mounting bracket 320 in a first direction. As another example, surface 352 of housing 310 and surface 322 of mounting bracket 320 may be placed adjacent to each other, apertures 372 and threaded apertures 314 may be aligned with each other, and a fastening device may be inserted through the apertures. The result is that electrical connection port 311 faces away from mounting bracket 320 in a second direction that is offset ninety degrees from the first direction. Access apertures 381 at surface 321 of mounting bracket 320 allow a screwdriver or the like to reach a fastening device to be inserted in apertures 372. In addition to the two mounting scenarios given here, many other scenarios and orientations for attaching housing 310 and mounting bracket 320 are available. An examination of FIG. 3 and an understanding of the foregoing discussion will make clear the nature of many such scenarios and orientations, at least one of which may be suitable for any job with which electrical connectivity system 300 is used.

Figure 4:
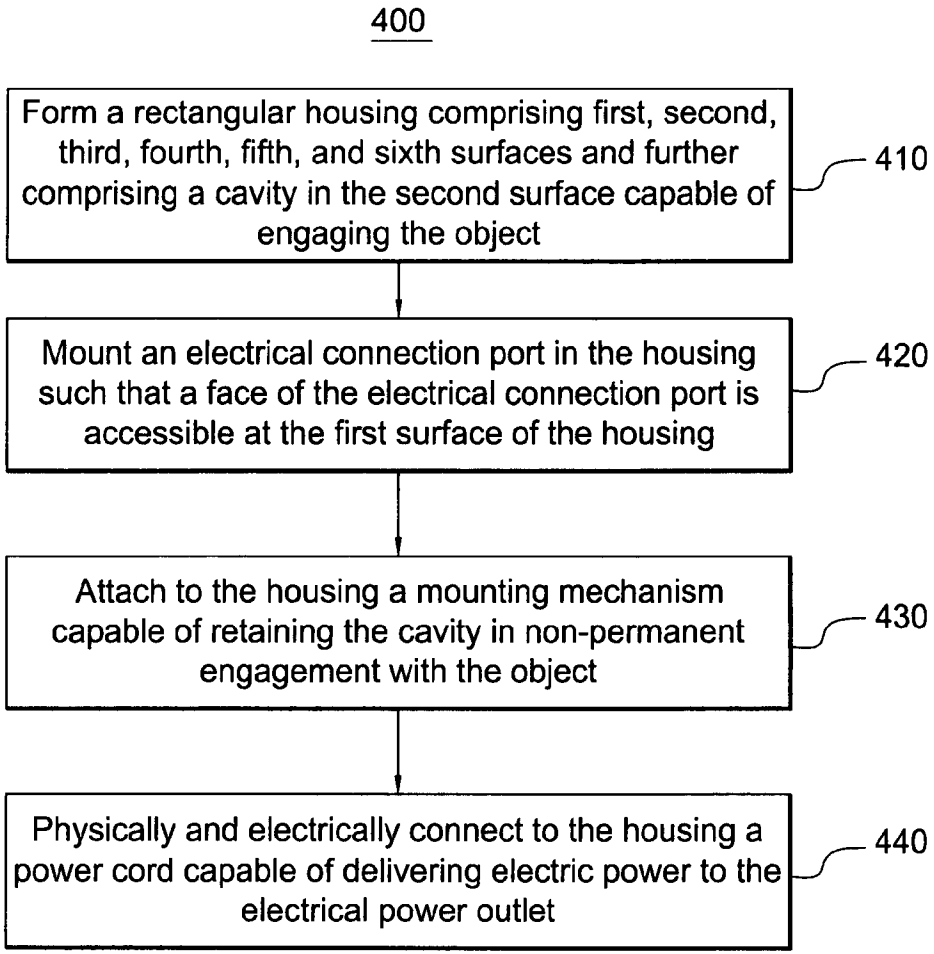
FIG. 4 is a flowchart illustrating a method of manufacturing an electrical connectivity system capable of being mounted to an object according to an embodiment of the invention.

FIG. 4 is a flowchart illustrating a method 400 of manufacturing an electrical connectivity system capable of being mounted to an object according to an embodiment of the invention. A step 410 of method 400 is to form a rectangular housing comprising first, second, third, fourth, fifth, and sixth surfaces and further comprising a cavity in the second surface capable of engaging the object. A manner in which the housing may be formed is known in the art, and can be, for example, an injection molding process.

As an example, the housing can be similar to housing 110, first shown in FIG. 1. As another example, the first, second, third, fourth, fifth, and sixth surfaces can be similar to, respectively, surfaces 151, 152, 153, 154, 155, and 156, first shown in FIG. 1. As another example, the object can be similar to object 101, first shown in FIG. 1. As yet another example, the cavity can be similar to cavity 112, also first shown in FIG. 1.

A step 420 of method 400 is to mount an electrical connection port in the housing such that a face of the electrical connection port is accessible at the first surface of the housing. As an example, the electrical connection port can be similar to electrical connection port 111, first shown in FIG. 1. As another example, the first surface of the housing can be similar to surface 151, also first shown in FIG. 1. In one embodiment, step 420 or another step comprises mounting a second electrical connection port in the housing such that a face of the second electrical connection port is accessible at one of the third, fourth, fifth, and sixth surfaces of the housing. In the same or another embodiment, step 430 or another step further comprises mounting a third electrical connection port in the housing such that a face of the third electrical connection port is accessible at a different one of the third, fourth, fifth, and sixth surfaces of the housing. As an example, the second and third electrical connection ports can be similar to electrical connection port 111. The electrical connection ports, along with the associated circuitry internal to the housing may be mounted in the housing according to standard or known techniques.

A step 430 of method 400 is to attach to the housing a mounting mechanism capable of retaining the cavity in non-permanent engagement with the object. As an example, the mounting mechanism can be similar to mounting mechanism 120, first shown in FIG. 1. The mounting mechanism can be molded with the housing in an injection molding process or can be attached to the housing after the housing is formed, such as with a hinge or pin. The hinge or pin can be molded into the housing or can be attached in some other fashion. Such molding and fastening methods are known in the art.

A step 440 of method 400 is to physically and electrically connect to the housing a power cord capable of delivering electric power to the electrical power outlet. The manner in which the power cord is physically and electrically connected to the housing is known in the art. As an example, the power cord can be similar to power cord 130, first shown in FIG. 1.

Figure 5:
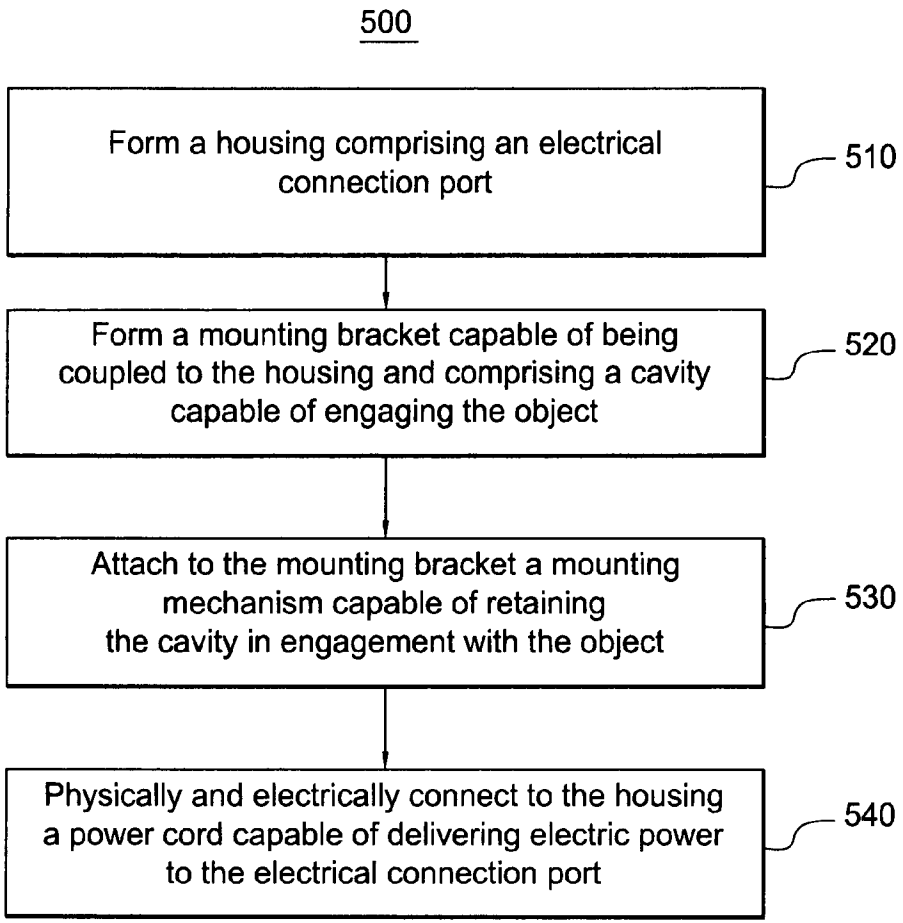
FIG. 5 is a flowchart illustrating a method of manufacturing an electrical connectivity system capable of being mounted to an object according to a different embodiment of the invention.

FIG. 5 is a flowchart illustrating a method 500 of manufacturing an electrical connectivity system capable of being mounted to an object according to an embodiment of the invention. A step 510 of method 500 is to form a housing comprising an electrical connection port. A manner in which the housing may be formed is known in the art, and can be, for example, an injection molding process. Mentioned above was an embodiment in which the housing comprises a threaded aperture. As an example, the threaded aperture can be formed of the same material used for the housing itself, in which case the threaded aperture may be molded with the housing in the injection molding process. As another example, the threaded aperture can be a harder material such as a metal insert, which can be molded into the housing or inserted after the housing is formed. The electrical connection ports, along with the associated circuitry internal to the housing may be mounted in the housing according to standard or known techniques.

As an example, the housing can be similar to housing 310, first shown in FIG. 3. As another example, the electrical connection port can be similar to electrical connection port 311, also first shown in FIG. 3. As yet another example, the object can be similar to object 101, first shown in FIG. 1. In one embodiment, step 510 or another step comprises forming the housing to have one or more electrical connection ports in addition to the electrical connection port. As an example, the one or more additional electrical connection ports can be similar to electrical connection port 311.

A step 520 of method 500 is to form a mounting bracket capable of being coupled to the housing and comprising a cavity capable of engaging the object. The mounting bracket may be formed using standard or known techniques for working with metal, plastic, or other material from which the mounting bracket is made. As an example, the mounting bracket can be similar to mounting bracket 320, first shown in FIG. 3. As another example, the cavity can be similar to cavity 340, also first shown in FIG. 3.

A step 530 of method 500 is to attach to the mounting bracket a mounting mechanism capable of retaining the cavity in engagement with the object. As an example, the mounting mechanism can be similar to mounting mechanism 350, first shown in FIG. 3. The mounting mechanism can be molded with the mounting bracket in an injection molding process or can be attached to the mounting bracket after the mounting bracket is formed, such as with a hinge or pin. The hinge or pin can be molded into the mounting bracket or can be attached in some other fashion. Such molding and fastening methods are known in the art.

A step 540 of method 500 is to physically and electrically connect to the housing a power cord capable of delivering electric power to the electrical connection port. The manner in which the power cord is physically and electrically connected to the housing is known in the art. As an example, the power cord can be similar to power cord 330, first shown in FIG. 3.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the electrical connectivity system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electrical connectivity system capable of being mounted to an object, the electrical connectivity system comprising:

a housing comprising:

an electrical connection port; and a cavity capable of engaging the object;

a mounting mechanism integrated with the housing and capable of retaining the cavity in engagement with the object; and a power cord integral with the housing and capable of delivering electric power to the electrical connection port, wherein:

the housing has a rectangular structure comprising:

a first surface;

a second surface spaced apart from and substantially parallel to the first surface;

a third surface substantially perpendicular to and extending between the first surface and the second surface; and a fourth surface spaced apart from the third surface and substantially perpendicular to and extending between the first and second surfaces;

the electrical connection port is located at the first surface; and the cavity is located at the second surface.

2. The electrical connectivity system of claim 1 wherein:

the housing further comprises:

a fifth surface substantially perpendicular to and stretching between the first and second surfaces, and substantially perpendicular to and stretching between the third and fourth surfaces; and a sixth surface spaced apart from and substantially parallel to the fifth surface, substantially perpendicular to and stretching between the first and second surfaces, and substantially perpendicular to and stretching between the third and fourth surfaces; and the power cord exits the housing at one of the fifth surface and the sixth surface.

3. The electrical connectivity system of claim 1 further comprising:

a second electrical connection port at the third surface.

4. The electrical connectivity system of claim 3 further comprising:

a third electrical connection port at the fourth surface.

5. The electrical connectivity system of claim 1 wherein:

the mounting mechanism increases friction between a portion of the electrical connectivity system and the object.

6. The electrical connectivity system of claim 5 wherein:
the mounting mechanism comprises an over-center cam lock.

7. The electrical connectivity system of claim 1 wherein:
the cavity has an effective width no greater than five centimeters.

8. The electrical connectivity system of claim 7 further comprising:
an adapter capable of insertion within the cavity and further capable of reducing the effective width of the cavity.

9. An electrical connectivity system capable of being mounted to an object, the electrical connectivity system comprising:
a housing having a first surface, a second surface, a third surface, and a fourth surface;
a first plurality of electrical power outlets at the first surface of the housing;
a cavity in the second surface of the housing capable of engaging the object;
a mounting mechanism integrated with the housing and capable of retaining the cavity in removable engagement with the object; and
a power cord integral with the housing and capable of delivering electric power to the first plurality of electrical power outlets,
wherein:
the mounting mechanism is located at the third surface of the housing; and
a portion of the mounting mechanism extends away from the third surface and contacts the object when the object is inserted in the cavity and when the mounting mechanism is in a first position.

10. The electrical connectivity system of claim 9 wherein:
the electrical connectivity system further comprises a second plurality of electrical connection ports at the third surface of the housing.

11. The electrical connectivity system of claim 10 further comprising:
a third plurality of electrical connection ports at the fourth surface of the housing.

12. The electrical connectivity system of claim 9 wherein:
the cavity comprises a first portion and a second portion exterior to the first portion;
the object fills the first portion and does not fill the second portion when the object is inserted in the cavity; and
a portion of the mounting mechanism extends across the second portion of the cavity and contacts the object when the object is inserted in the cavity and the mounting mechanism is in a first position.

13. An electrical connectivity system capable of being mounted to an object, the electrical connectivity system comprising:
a housing comprising an electrical connection port;
a mounting bracket capable of being coupled to the housing and comprising a cavity capable of engaging the object and a mounting mechanism capable of retaining the cavity in engagement with the object; and
a power cord integral with the housing and capable of delivering electric power to the electrical connection port,
wherein:
the mounting bracket comprises:
a first surface;
a second surface spaced apart from and substantially parallel to the first surface; and
a third surface substantially perpendicular to and extending between the first surface and the second surface;
the first surface, the second surface, and the third surface define the cavity;
the mounting mechanism is at the first surface;
the mounting bracket comprises a first aperture at the second surface and a second aperture at the third surface;
the housing comprises a threaded aperture; and
the mounting bracket and the housing are coupled to each other using the threaded aperture and one of the first and second apertures.

14. The electrical connectivity system of claim 13 wherein:
the mounting mechanism comprises an over-center cam lock.

15. The electrical connectivity system of claim 13 wherein:
the cavity has an effective width no greater than five centimeters.

16. The electrical connectivity system of claim 15 further comprising:
an adapter capable of insertion within the cavity and further capable of reducing the effective width of the cavity.

* * * * *